US006290477B1

(12) United States Patent
Gigon

(10) Patent No.: US 6,290,477 B1
(45) Date of Patent: Sep. 18, 2001

(54) SCROLL VACUUM PUMP

(75) Inventor: René Gigon, Porrentruy (CH)

(73) Assignee: Ateliers Busch SA, Chevenez (CH)

( * ) Notice: Subject to any disclaimer, the term of this patent is extended or adjusted under 35 U.S.C. 154(b) by 0 days.

(21) Appl. No.: 09/508,244

(22) PCT Filed: Sep. 16, 1997

(86) PCT No.: PCT/CH97/00343

§ 371 Date: Mar. 9, 2000

§ 102(e) Date: Mar. 9, 2000

(87) PCT Pub. No.: WO99/14502

PCT Pub. Date: Mar. 25, 1999

(51) Int. Cl.[7] ..... F03C 21/00

(52) U.S. Cl. ..... 418/55.2; 418/55.3; 418/55.4; 418/60; 418/101; 418/157

(58) Field of Search ..... 418/55.2, 60, 55.3, 418/107, 151, 55.4

(56) References Cited

U.S. PATENT DOCUMENTS

| | | | | |
|---|---|---|---|---|
| 4,990,071 | * | 2/1991 | Sugimoto | 418/55.5 |
| 5,024,589 | * | 6/1991 | Jetzer et al. | 418/55.3 |
| 5,209,636 | | 5/1993 | Fannar . | |
| 5,391,065 | * | 2/1995 | Wolverton et al. | 418/55.3 |
| 5,556,269 | * | 9/1996 | Suzuki et al. | 418/55.3 |
| 5,842,843 | * | 12/1998 | Haga | 418/55.2 |
| 6,109,897 | * | 8/2000 | Haga | 418/55.1 |

FOREIGN PATENT DOCUMENTS

| | | | | |
|---|---|---|---|---|
| 35 38 522 A1 | | 12/1986 | (DE) . | |
| 0 780 576 A2 | | 6/1997 | (EP) . | |
| 3-237202 | * | 11/1991 | (JP) | 418/55.3 |
| A-5-79473 | | 3/1993 | (JP) . | |

* cited by examiner

*Primary Examiner*—Thomas Denion
*Assistant Examiner*—Theresa Trieu
(74) *Attorney, Agent, or Firm*—Oliff & Berridge, PLC.

(57) ABSTRACT

The scroll pump has the capability of preserving a minimal play between the joints disposed on the ridges of each of the spiraling walls and the flat wall facing it. Such an arrangement, possible owing to the slight difference in pressure prevailing between two adjacent transfer chambers, makes it possible to prevent wear and tear on the joints, soiling of the transfer chambers as well as overheating due to friction on the joints.

13 Claims, 3 Drawing Sheets

SCROLL VACUUM PUMP

Figure 1:
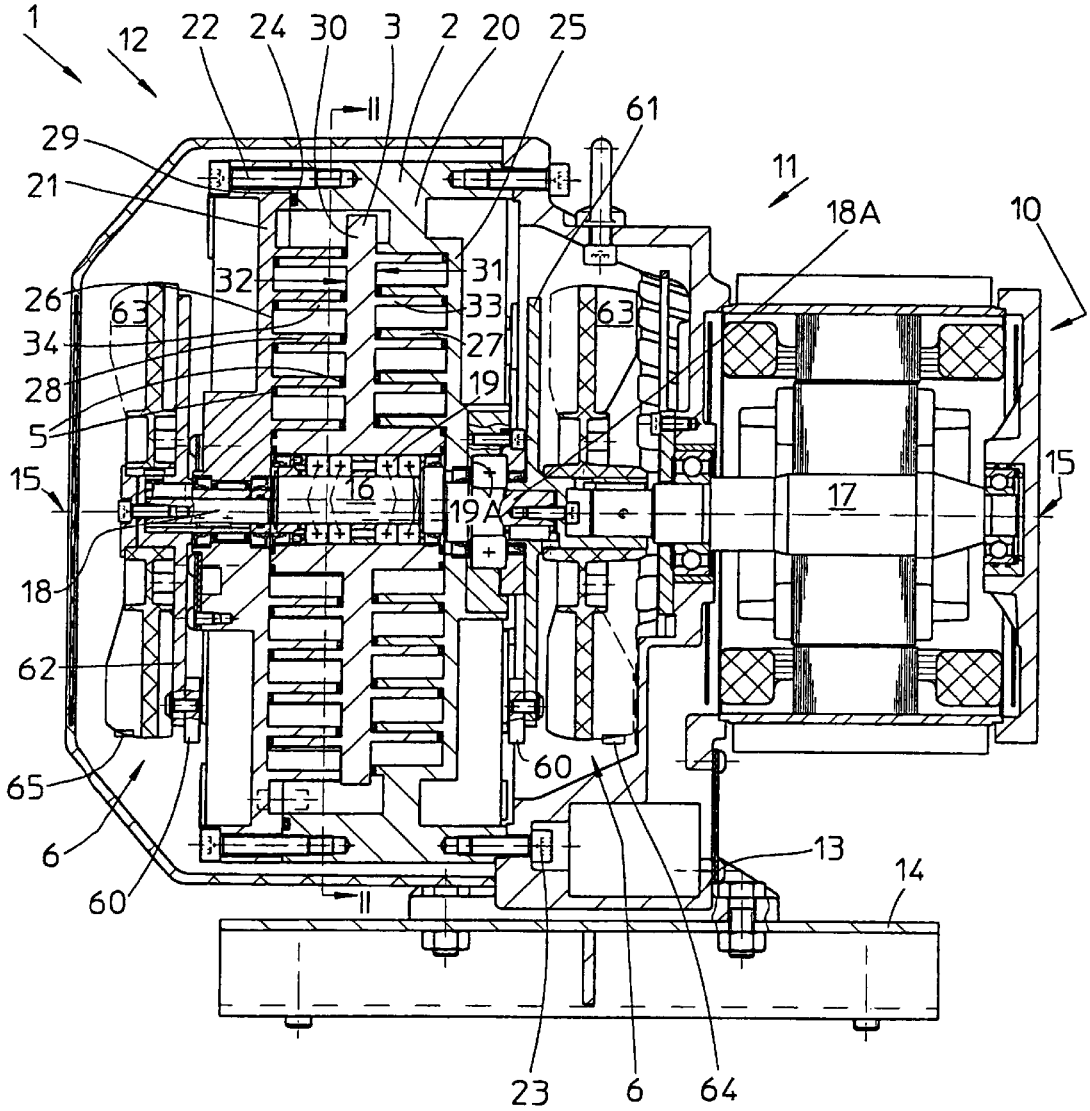

The present invention concerns a scroll vacuum pump, in particular the means allowing a certain tightness to be ensured between the moving part and the fixed part of the pump.

Scroll vacuum pumps are known in general in the state of the art. They are composed in particular of a portion of fixed housing supporting at least a first wall in the form of a scroll, and a mobile portion, supporting at least a second wall in the form of a scroll, by displacement in an orbital movement inside the said portion of housing. Since the two scrolls are interleaved one on the other, the orbital movement of the scroll mounted on the mobile portion relative to the scroll mounted on the fixed portion of housing creates a change of shape and a displacement, along the said scrolls, of a plurality of transfer chambers, each bounded by a wall portion of the fixed housing portion, of the mobile portion as well as of the two scrolls. As for a transfer chamber, its displacement thus brings a quantity of gas or air, introduced into the said chamber when this is located at one end of the said scrolls, toward the other end of the said scrolls where the said quantity of gas or air can escape. In the case where the gas or air is introduced from outside the scrolls to be drawn into the scrolls, there is a decrease in the volume of the transfer chamber between these two points, respectively an increase in the pressure of the gas or air.

The advantage of such pumps is that they can work completely dry, i.e. no lubricant comes into contact with the pumped gas or air which thus cannot be contaminated, making them particularly suitable for laboratories, the chemical industry, the food industry, etc.

One major problem with the known pumps consists in ensuring the tightness of the transfer chamber between the ridge of the fixed scroll and the wall portion of the mobile portion facing it as well as between the ridge of the mobile scroll and the wall portion of the fixed portion of casing facing it, respectively between the transfer chambers.

A known way of resolving this problem consists in allowing a slight axial movement of the mobile portion on its axis, and ensuring the tightness of the transfer chamber by arranging a joint disposed in a groove running along the ridges of the scrolls, the said joints coming into sliding contact against the walls facing them, thus leading the mobile portion in an orbital displacement so that it centers itself inside the fixed portion of casing. Owing to the sliding contact mentioned, the joint must be a friction joint, i.e. relatively rigid, respectively having only little elasticity. In order to allow dimensional adaptation of the joints to ensure the tightness of the transfer chamber, a first method consists in sandwiching a flexible joint between the bottom of the groove and the friction joint; the dimensional adaptation being produced by the flexible joint. A major drawback of this solution is its high cost. A second method consists in providing an air circulation channel between the bottom of the groove and the sliding joint, this air circulation channel having an intake orifice in a place on the scroll where the air is under relatively high pressure. One of the drawbacks of this method comes from irregularities of effect between the different operating speeds of the pump. On the other hand, and in a general way, these systems where the joints are in sliding contact with a wall result in wear and tear on the said joints, or a soiling of the transfer chamber and the necessity of frequent changing of joints as well as overheating of the walls on which the joints slide. Moreover, the tightness is not ensured in the same way between new joints and worn joints, leading to a gradual loss of performance of the pump in the course of use.

A first object of the invention is thus to propose a scroll vacuum pump not having the mentioned drawbacks of the known pumps.

To achieve this, the pump proposed avoids using joints in sliding contact on a wall; instead, a very slight play is left between the joint and the wall facing it when the pump is assembled. This first arrangement makes it possible to avoid having to install an elastic means Linder the joint. Moreover, in order to prevent the undesired effect of having the joint come into sliding contact with the wall at the wrong moment, the mobile portion is mounted on its axis so that no axial movement is possible. Thus, all the problems of friction, of wear and tear and of overheating between the fixed and mobile portions are avoided, while ensuring a sufficient tightness of the transfer chamber. A second embodiment allows completely omitting joints between the fixed and mobile portions.

Another problem relating to scroll vacuum pumps is the disequilibrium created by the mobile portion mounted eccentrically relative to the drive shaft, thus causing vibrations when the vacuum pump is functioning. In a known way, one or more counterweights adjoining the drive shaft allow a static equilibrium of the masses in rotation to be achieved. In the case of a vacuum pump whose mobile portion comprises two spiraling walls each disposed on a face of a central wall, an offsetting of one hundred eighty degrees between the two scrolls already makes it possible to diminish substantially the disequilibrium of the masses in rotation. This arrangement also has the advantage of reducing by a factor of two the gas or air depression points at the inlet of the pump, respectively the pressure points at the outlet of the pump while doubling their frequency. Nevertheless, in operation, vibrations originating from a lack of dynamic equilibrium can act upon the mobile part and not allow it to keep the play previously described between the joint and the wall facing it. In order to avoid this, the mobile portion of the vacuum pump is also balanced dynamically.

To attain the set objects, a scroll vacuum pump is proposed having the features of the main claim, variants or special embodiments being described in the dependent claims.

Figure 2:
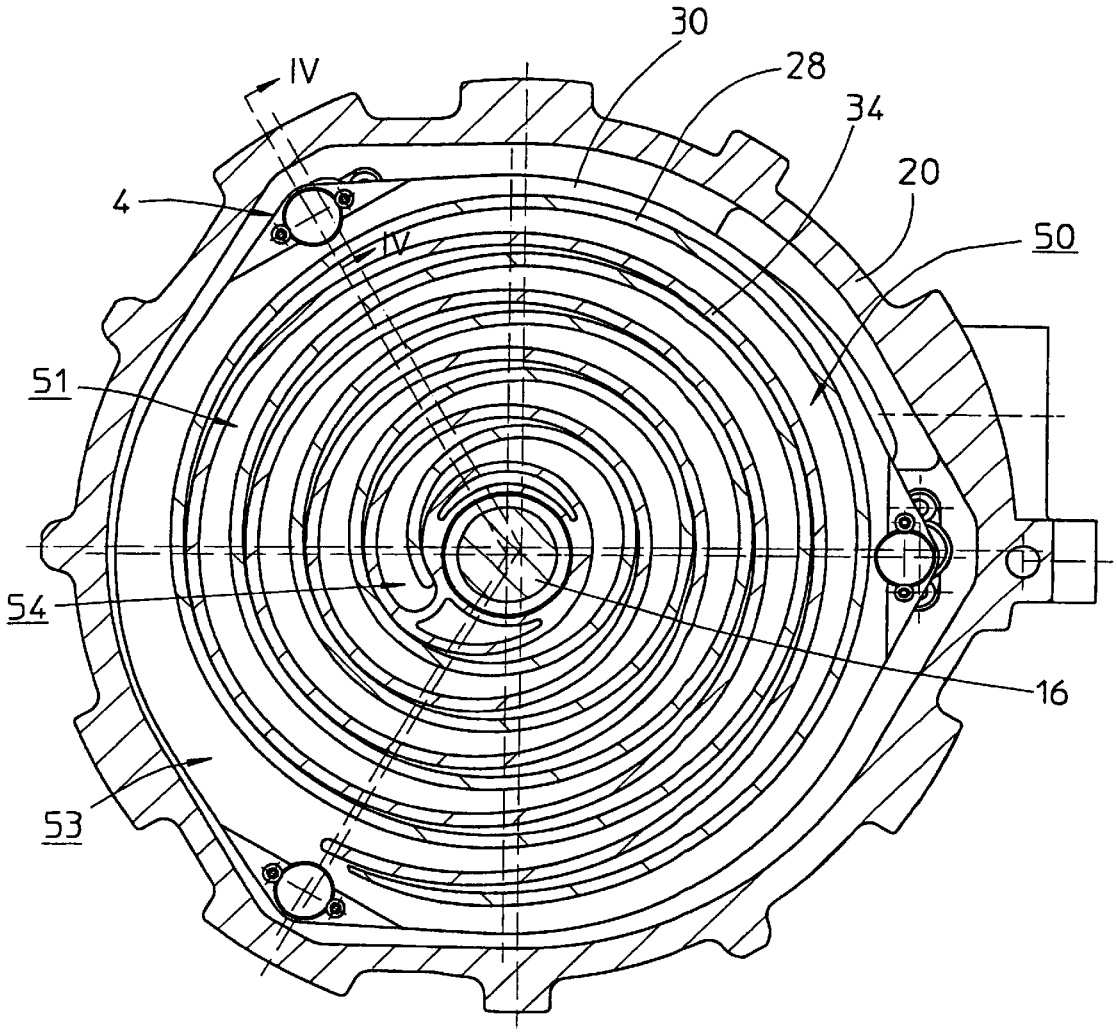
Figure 3A:
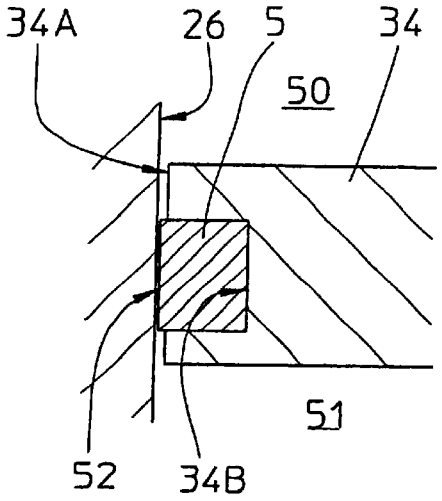
Figure 3B:
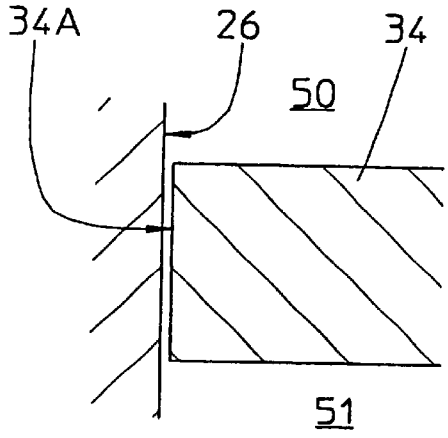
Figure 4:
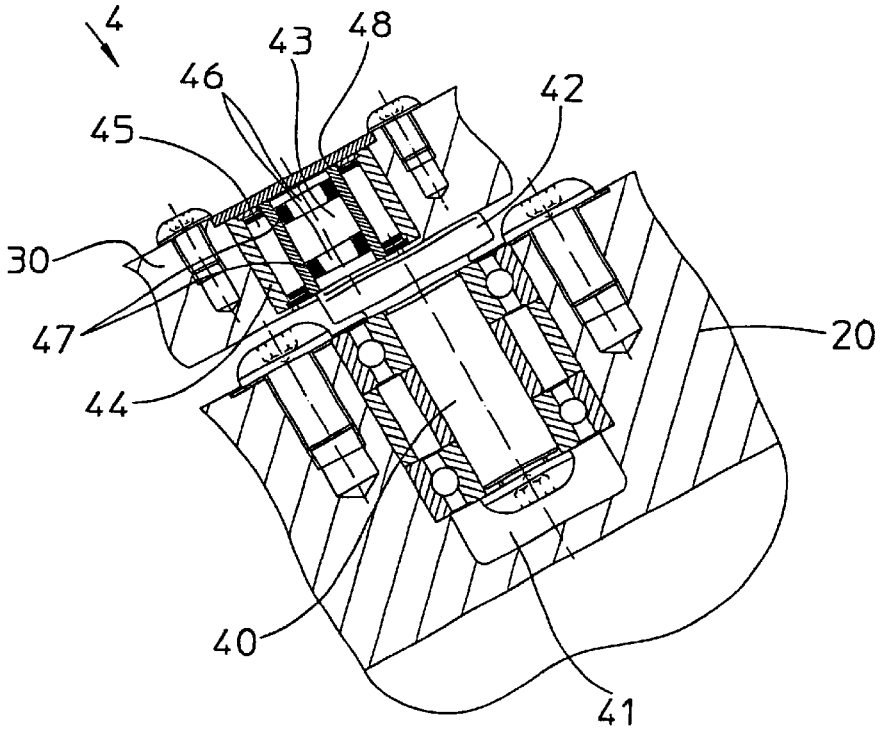

The description which follows of a preferred embodiment of a scroll vacuum pump according to the invention is to be considered with reference to the annexed drawing comprising the figures where:

FIG. 1 represents a longitudinal section of a preferred embodiment of a scroll vacuum pump according to the invention, FIG. 2 represents a transverse section along the line II—II of the preceding figure, FIG. 3A represents an enlarged portion, in section, of a scroll joint, FIG. 3B represents the same portion of the device in the embodiment without joint, and FIG. 4 represents an enlarged view, in section, along the line IV—IV of FIG. 2.

FIG. 1 shows a preferred embodiment of a scroll vacuum pump 1, seen in section along its longitudinal axis. The pump shown is composed of a drive part 10, in the present case an electric motor, a coupling part 11 as well as a pump body 12, these three elements being connected by an external body 13, itself mounted on a framework 14. The pump body 12 comprises essentially a fixed portion 2 and a mobile portion 3.

In this embodiment, the fixed portion 2 is composed of two half-shells 20 and 21, fixed together by fixing means, such as, for example, the screws 22, the half-shell 20 being fixed to the body 13, respectively to the framework 14, by other fixing means, such as, for example, the screws 23. A circular sealing joint 24 ensures the tightness between the two half-shells 20 and 21. The bottom walls 25, respectively 26, of the two half-shells 20 and 21 are essentially flat along a plane perpendicular to the axis 15 of the pump and each include a spiraling wall 27, respectively 28, projecting perpendicularly to the said bottom walls 25 and 26, and extending from a region close to the large-diameter part of the wall 25 or 26 toward a region close to the center of each of the same walls.

The mobile portion 3 is composed of a central disk 30 supporting on each of its opposite faces 31 and 32 a spiraling wall 33, respectively 34, projecting perpendicularly to the said faces 31 and 32, and extending from a region close to the large-diameter part of the face 31 or 32 toward a region close to the center of each of the same faces.

FIG. 2, which is a section along the line II—II of FIG. 1, shows the halfshell and the scroll 28 which is contiguous to the half-shell 21, as well as the central disk 30 and the scroll 34 which is contiguous to it. One sees that the two scrolls 28 and 34 have the same evolution and are interleaved.

The disk 30 is mounted at its; center on a portion of shaft 16 mounted eccentrically to the axis 15 of the drive shaft 17 of the pump (see FIG. 1). Moreover the disk 30 is guided by eccentric guide means 4 (see FIG. 2). Thus, the disk 30, respectively the entire mobile portion 3, has an orbital movement during the rotation of the drive shaft 17. As is seen in FIG. 2, this orbital movement between the mobile scroll 34 and the fixed scroll 28 causes a change of form, a displacement and a reduction of volume of a transfer chamber 50 disposed between the walls of the two said scrolls, leading to entry and compression of the gas or air it contains. As previously indicated, the same arrangement of scrolls 27 and 33 is provided on the other side of the disk 30, for the same effect.

It is understood from the foregoing that an important point of the device consists in ensuring tightness of the transfer chamber during the orbital movement of the mobile portion 3. When referring to FIG. 3A, one sees an enlarged portion of a ridge of the mobile scroll 34 facing the bottom wall 26 of the half-shell 21. The problem and the figure are identical in the case of the other mobile scroll 33 or fixed croll 27 on 28 facing the wall which respectively faces them.

During its orbital movement, the upper ridge 34A of the scroll 34 sweeps a portion of the surface of bottom wall 26. According to this embodiment, the scroll 34 includes a joint 5 on its upper ridge 34A in order to separate two transfer chambers 50 and 51 disposed of each side of the scroll 34. The joint 5 has the same scroll shape as the spiraling wall which supports it, being fixed in a groove accommodation 34B disposed in the ridge 34A. Since this joint must be able to slide on the bottom wall 26, it is generally fairly rigid and not very compressible. In order to ensure the tightness between the transfer chambers 50 and 51 in today's existing pumps, pressure means have been provided under the joint to make the upper face 52 of said joint press against the wall 26. These pressure means consisted of either a second elastic joint disposed at the bottom of the accommodation 34B or a gas or air pressurized chamber disposed in the bottom of the accommodation 34B. As previously indicated, these means have led to overheating duct friction between the joint and the wall, wear and tear on the joint and soiling of the transfer chambers.

The solution proposed here takes into account the fact that two opposite transfer chambers on a scroll, the two chambers 50 and 51 in the example shown, have pressures that differ relatively little between them on a given portion of surface 26, respectively for a predetermined angular position of the orbital movement (see FIG. 2). If the absolute pressure in one transfer chamber increases regularly during its passage from the beginning of the scroll toward the center thereof, the difference in pressure between two contiguous chambers is relatively slight. Thus absolute tightness is not necessary. The device therefore comprises, according to this embodiment, a joint 5, rigid or semi-rigid, non-deformable, mounted in a groove accommodation 34B on a ridge 34A of the scroll 34. The entire device is mounted in such a way as to allow minimal play, on the order of from 0 to 5 hundredths of a mm, between the upper face 52 of the joint 5 and the wall 26. This minimal play makes it possible to avoid the aforementioned drawbacks, i.e. overheating of the joint against the wall, wear and tear on the joint and soiling of the transfer chambers. The joint 5 has been represented here as having a flat upper surface 52; such an arrangement is not absolutely necessary. This surface could just as well be curved or have a ridge line facing the wall opposite it, what is important is the mentioned minimal play which must exist between the portion of the joint closest to the wall facing it and the said wall.

According to a second embodiment, shown in FIG. 3B, the joint 5 has been omitted, and it is the upper ridge 34A of the scroll 34 directly which is separated from the wall facing it by a play ranging between 0 and 5 hundredths of a mm. As in the foregoing, it is not essential that this upper ridge be flat.

In order to guarantee this play between the joint 5, respectively the uldge 34A, and the wall facing it, particular precautions are to be taken in mounting of the mobile portion 3 relative to the fixed portion 2. First of all, in order to guarantee a predetermined spacing between the walls 25 and 26 of the two half-shells 20 and 21, a circular shim 29 of predetermined thickness can be disposed between the two half-shells 20 and 21 (see FIG. 1). Likewise, the axial movement of the mobile portion 3, respectively of the disk 30 bearing the scrolls 33 and 34, can be eliminated by rolling bearings without play 19, the immobilization of the disk 30 on the eccentric bearing surface 16 also bearing obtained by shims disposed at suitable places, such as the shims 19A, for example. Thus, the disk 30 bearing the scrolls 33 and 34 can be centered exactly in the space between walls 25 and 26 of the half-shells 20 and 21, leaving a predetermined play on the order of a few hundredths of a mm between the joints 5, respectively the upper ridges of the spiraling walls, and the walls 25 or 26 facing them.

The necessity of keeping a constant play between the joints or the ridges of the spiraling walls and the walls facing them involves eliminating the vibrations caused by the orbital movement of the mobile portion 3, and by the rotation of all the rotating pieces of the device, i.e. in particular the rotor of the motor as well as the ventilation means. Balancing means 6 are provided for this purpose. A first balancing means involves providing one or more counterweights 60 mounted in rotation with the axis of rotation 15 of the mobile portion 3. To achieve this, a first fixing disk 61 is fixed on the end of the portion of shaft 18A close to the drive shaft 17, and a second fixing disk 62 is fixed on a portion of shaft 18, aligned along the axis 15 and disposed on the other side of the eccentric portion of shaft 16, the counterweights 60 being fixed on the fixing disks 61 and 62. It is seen in FIG. 1 that for saving space, the two fixing disks 61 and 62 are juxtaposed with wheels bearing the ventilation means 63 of the pump and of the motor, without this being absolutely necessary for the pump to function according to the invention. The weight and the position of each of the counterweights 60 is determined in a known way for a static balance in order to counterbalance the disequilibrium created by the eccentric mobile portion 3 and by other instances of imbalance of the rotating parts. In order to reduce this imbalance, a second balancing means consists in offsetting the scrolls 27 and 33 angularly by one hundred eighty degrees with respect to the scrolls 28 and 34. When referring to FIG. 2, it can be seen that when the intake openings of the scrolls 28 and 34 are situated at approximately seven o-clock, the scrolls 27 and 33 disposed on the other side of the disk 30, and not visible in the figure, have their intake openings situated at approximately at one o'clock. Such an arrangement reduces slightly the disequilibrium of the mobile portion 3. Another advantage of such an arrangement being that when placing in parallel the inlets and outlets of gas and of air of the scrolls on the orifices of intake, respectively of lift of the pump, the range of fluctuations of pressure of gas or of air is reduced by half while the frequency of the fluctuations is doubled. Thus a more regular suction, respectively expulsion, of gas or air is obtained.

The two balancing means mentioned provide a static balancing of the mobile portion 3 of the pump; in order to ensure that the play of a few hundredths of a mm on the joints mentioned above is maintained during operation of the pump, a dynamic balancing of the entire rotating part of the device is also carried out according to a known technique of dynamic balancing. Shown in FIG. 1 are small weights 64 and 65 disposed respectively on the ventilation means 63 which have been fixed during this dynamic balancing operation.

It has been mentioned previously that the central disk 30 is guided by eccentric guide means 4. When referring to FIG. 2, it is seen that the device here comprises three guide means 4. These guide means are intended to prevent the central disk 30 from turning with the rotation of the eccentric bearing surface 16, while having the desired orbital movement. To achieve this, as seen in FIG. 4, each guide means 4 is made up of a first shaft portion 40, rotating in an accommodation 41 provided in the half-shell 20. A crank pin 42 is fixed to one end of the first shaft portion 40, the said crank pin bearing a second shaft portion 43 mounted eccentrically with respect to the first shaft portion 40. The offset value between the shaft portions 43 and 40 corresponds to the offset value between the drive shaft 17 and the eccentric bearing surface 16. The second shaft portion 43 is mounted pivoting in an accommodation 44 of the central disk 30, a needle roller bearing 45 ensuring this pivoting. Since the central disk 30 is guided during its orbital movement by the eccentric bearing surface 16 as well as by the shaft portions 43, i.e. at more than two points, there could be a blockage of the orbital movement or at the very least heavy wear and tear on the bearings in the case where the dimensional manufacturing tolerances are not compensated. To alleviate this, it is necessary to provide the possibility of adapting the positioning of the central disk 30 relative to the guide means 4. For this purpose, the shaft bearing surface 43 includes at least one recess 46 in which an topic elastic joint of the O-ring type is disposed. Owing to the elasticity of the joint or joints 47, the positioning of the central cage 48 of the bearing 45, respectively of the central disk 30 relative to the shaft portion 43, respectively to the half-shell 20, adapts itself automatically. The device has been described equipped with three guide means 4; another number of such means or other means could be provided in order to prevent the rotation of the disk 30 and to allow the orbital movement described.

The embodiment of a scroll vacuum pump described here is only one preferred embodiment in which the two pairs of spiraling walls 27, 33 and 28, 34 function in parallel, i.e. the two sets of scrolls are identical, being only offset by one hundred eighty degrees as indicated and the intake chambers of the two sets of scrolls are connected together on the intake orifice of the pump whereas the two expulsion chambers of the two sets of scrolls are also connected together on the expulsion orifice of the pump. FIG. 2 shows the intake chamber 53 and the expulsion chamber 54 of the set of scrolls 28, 34. The means allowing the chambers to be connected together and to be connected to their respective orifice are known in the art. Other embodiments are also possible, for example, a two-stage vacuum pump where the expulsion chamber of a first set of scrolls is connected to the intake chamber of the second set of scrolls; in this case, the two sets of scrolls are not identical, the second set having a higher compression rate. There could also be a single set of spiraling walls, the fixed portion being made up of a single half-shell and the disk in orbital movement having a single set of spiraling wall <sic. walls> on just one of its faces. Constructive arrangements other than those described can be provided while corresponding to the features of the claims.

What is claimed is:

1. Scroll vacuum pump comprising at least a fixed portion made up of two half-shells each including a substantially flat wall disposed perpendicularly to a longitudinal axis of the pump, a spiraling wall being disposed projecting perpendicularly on each of said substantially flat walls, a mobile portion including at least a disk parallel to said substantially flat walls and mounted pivotingly on a shaft bearing surface eccentric relative to a drive shaft parallel to said longitudinal axis, guide means imparting to said disk an orbital movement about the said eccentric bearing surface during rotation of the drive shaft, a spiraling wall being disposed projecting perpendicularly on each of the substantially flat opposite faces of said disk, the spiraling wall of each of the two half-shells of the fixed portion being directed toward the substantially flat face facing it of said disk and the spiraling wall of each of the faces of the mobile portion being directed toward the said substantially flat wall of the half-shell facing it of the fixed portion, each pair of two corresponding spiraling walls being made up of two spiraling walls having substantially the same shape and being interleaved one on the other, each spiraling wall including an upper non-deformable ridge close to the substantially flat wall or face facing it, a slight play being provided between each of the said upper ridges and the substantially flat wall or face facing it, characterized in that the beginnings of the spirals of the pair of spiraling walls disposed on one side of the central disk arc offset by one hundred eighty degrees relative to the beginnings of the spirals of the pair of spiraling walls disposed on the other side of the central disk, and a distance provided between each of the said upper ridges and the substantially flat wall or face facing it ranges between 0 and 5 hundredths of a mm.

2. Vacuum pump according to claim 1, characterized in that the said upper ridge is disposed on the upper face of a joint disposed in an accommodation provided on the ridge of the said spiraling wall.

3. Vacuum pump according to claim 1, characterized in that the said upper edge is disposed on the upper face of the ridge of the said spiraling wall.

4. Vacuum pump according to claim 1, characterized in that it further comprises means making it possible to ensure a fixed spacing between the said substantially flat walls of the fixed portion and the said substantially flat faces of the mobile portion.

5. Vacuum pump according to claim 4, characterized in that the means making it possible to ensure a fixed spacing between the said substantially flat wall <sic. walls> of the fixed portion and the said substantially flat faces of the mobile portion are made up of at least one circular shim allowing the said fixed portion to be positioned axially relative to the framework of the pump.

6. Vacuum pump according to claim 1, characterized in that it further comprises means allowing the mobile portion to be immobilized axially so as to prevent any axial movement of the said mobile portion.

7. Vacuum pump according to claim 6, characterized in that the means allowing the mobile portion to be immobilized axially so as to prevent any axial movement of the said mobile portion are made up of rolling means and of shims able to fix the said mobile portion axially relative to a bearing surface of the drive shaft.

8. Vacuum pump according to claim 1, characterized in that the two sets of spiraling walls have the same shape and the same evolution, the inlet chambers of the two said sets of spiraling walls being connected, the two outlet chambers of the two said sets of spiraling walls being also connected.

9. Vacuum pump according to claim 1, wherein it comprises:

at least one means allowing the mobile portion to be immobilized in order to prevent any axial movement of the said mobile portion, at least one means allowing static and dynamic balancing of the pieces in rotation.

10. Vacuum pump according to claim 9, wherein, on the one hand, the balancing means comprises a plurality of counterweights and, on the other hand, a first fixing disk is fixed at one end of a shaft portion close to the drive shaft, and a second fixing disk is fixed on another shaft portion aligned on the axis and disposed at the other end of the eccentric portion, the counterweights being fixed on the said fixing disks.

11. A scroll vacuum pump comprising at least a fixed portion made up of two half-shells each including a substantially flat wall disposed perpendicularly to a longitudinal axis of the pump, a spiraling wall being disposed projecting perpendicularly on each of said substantially flat walls, a mobile portion including at least a disk parallel to said substantially flat wall and mounted pivotingly on a shaft bearing surface eccentric relative to a drive shaft parallel to said longitudinal axis, guide means imparting to said disk an orbital movement about said eccentric bearing surface during rotation of the drive shaft, a spiraling wall being disposed projecting perpendicularly on each substantially flat face opposite faces of said disk, the spiraling wall of each of the two half-shells the fixed portion being directed toward the substantially flat face of said disk and the spiraling wall of the mobile portion being directed toward the substantially flat wall of the half-shell facing it of the fixed portion, each pair of two corresponding spiraling walls being made up of two spiraling walls having substantially the same shape and being interleaved one on the other, each spiraling wall including an upper ridge close to the substantially flat wall or face facing it, a slight play being provided between each of the said upper ridges and the substantially flat wall or face facing it, the beginnings of the spirals, of the pair of spiraling walls disposed on one side of the central disk are offset by one hundred eighty degrees relative to the beginnings of the spirals of the pair of spiraling walls disposed on the other side of the central disk, characterized in that it further comprises means allowing the pieces in rotation to be balanced statically and dynamically.

12. A scroll vacuum pump comprising at least a fixed portion made up of two half-shells each including a substantially flat wall disposed perpendicularly to a longitudinal axis of the pump, a spiraling wall being disposed projecting perpendicularly on each of said substantially flat walls, a mobile portion including at least a disk parallel to said substantially flat wall and mounted pivotingly on a shaft bearing surface eccentric relative to a drive shaft parallel to said longitudinal axis, guide means imparting to said disk an orbital movement about said eccentric bearing surface during rotation of the drive shaft, a spiraling wall being disposed projecting perpendicularly on each substantially flat face opposite faces of said disk, the spiraling wall of each of the two half-shells the fixed portion being directed toward the substantially flat face of said disk and the spiraling wall of the mobile portion being directed toward the substantially flat wall of the half-shell facing it of the fixed portion, each pair of two corresponding spiraling walls being made up of two spiraling walls having substantially the same shape and being interleaved one on the other, each spiraling wall including an upper ridge close to the substantially flat wall or face facing it, a slight play being provided between each of the said upper ridges and the substantially flat wall or face facing it, the beginnings of the spirals of the pair of spiraling walls disposed on one side of the central disk are offset by one hundred eighty degrees relative to the beginnings of the spirals of the pair of spiraling walls disposed on the other side of the central disk, characterized in that the guide means imparting to said disk an orbital movement about the said eccentric bearing surface during rotation of the drive shaft are made up of at least a first shaft portion mounted pivotingly in an accommodation provided in the fixed portion, a crank pin equipped with a second shaft portion being mounted at one end of the said first shaft portion, said second shaft portion being eccentric relative to said first shaft portion by the same value as that of the eccentricity of said disk relative to the drive shaft, said second shaft portion being mounted pivotingly in an accommodation provided in said disk, means being provided to compensate the dimensional tolerances of positioning of said disk relative to the fixed portion.

13. Vacuum pump according to claim 12, characterized in that the said means provided to compensate the dimensional tolerances of positioning of the said disk relative to the fixed portion arc made up of at least one topic joint disposed in a recess provided on the circumference of the said second shaft portion introduced into an internal cage of a needle roller bearing.

* * * * *